United States Patent [19]

Schmidt et al.

[11] 4,370,200

[45] Jan. 25, 1983

[54] METHOD OF INFLUENCING A PRE-DRAINED FIBROUS WEB ON A SCREEN

[75] Inventors: Sylvia Schmidt, Reutlingen; Hansdieter Eckert, Eningen; Wolfgang Holzinger, Reutlingen; Dietrich Holle, Nideggen, all of Fed. Rep. of Germany

[73] Assignees: Neue Bruderhaus Maschinenfabrik GmbH, Reutlingen; Andreas Kufferath KG, Duren-Mariaweiler, both of Fed. Rep. of Germany; a part interest

[21] Appl. No.: 208,406

[22] Filed: Nov. 19, 1980

[30] Foreign Application Priority Data

Dec. 19, 1979 [DE] Fed. Rep. of Germany ..... 2951183

[51] Int. Cl.[3] ..... D21F 1/52; D21F 3/04; D21F 3/06

[52] U.S. Cl. ..... 162/210; 162/211; 162/217

[58] Field of Search ..... 162/203, 210, 211, 273, 162/217, 361

[56] References Cited

U.S. PATENT DOCUMENTS

| | | | |
|---|---|---|---|
| 2,890,149 | 6/1959 | Müller | 162/211 |
| 2,977,277 | 3/1961 | Kelly | 162/203 |
| 3,846,232 | 11/1974 | Kankaanpaa | 162/203 |
| 4,146,424 | 3/1979 | Justus . | |

FOREIGN PATENT DOCUMENTS

| | | | |
|---|---|---|---|
| 2132713 | 1/1973 | Fed. Rep. of Germany . | |
| 2838641 | 3/1979 | Fed. Rep. of Germany . | |
| 2003952 | 3/1979 | United Kingdom . | |
| 2013748 | 8/1979 | United Kingdom | 162/203 |

*Primary Examiner*—Steve Alvo

*Attorney, Agent, or Firm*—Wigman & Cohen

[57] ABSTRACT

A method and apparatus are disclosed for influencing the fibers in the uppermost layer of a fibrous web lying on a screen, for example, in applying a watermark or evening the surface of the web, wherein a surface compression is exerted on the web by a screen roller and a second screen guided around the screen roller. The surface compression is maintained over a variable time period and causes a water film to appear on the upper surface of the web, in which the fiber density is much less than in the web prior to the surface compression. This water layer is forcibly aspirated from the web and the fibers therein thus experience a reorientation and become set in desired positions.

6 Claims, 1 Drawing Figure

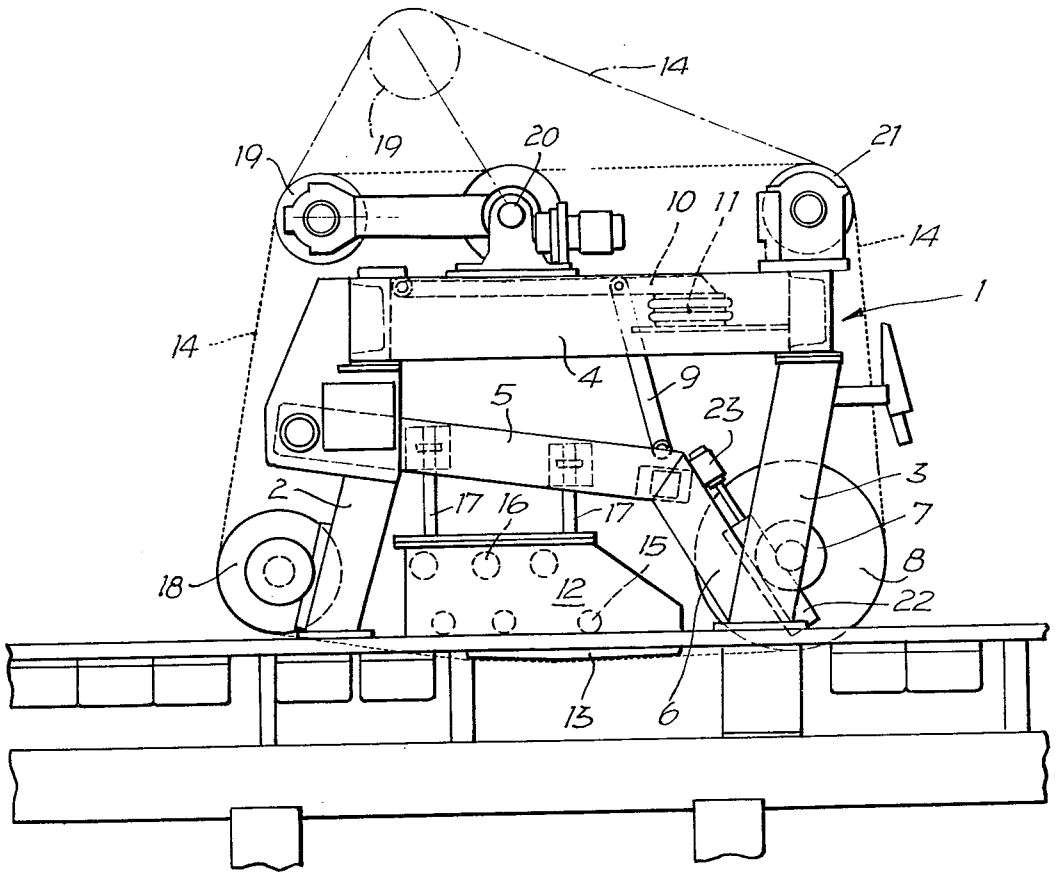
1
2
3
4
5
6
7
8
9
10
11
12
13
14
14
14
15
16
17
17
18
19
19
20
21
22
23

METHOD OF INFLUENCING A PRE-DRAINED FIBROUS WEB ON A SCREEN

BACKGROUND OF THE INVENTION

The invention relates to a method for influencing a pre-drained fibrous web on a screen, in which the fibrous web temporarily undergoes a surface compression by a second screen, and an apparatus for performing such a method.

In conventional methods of this type, a surface compression is exerted on a pre-drained fibrous web lying on a longitudinal screen by means of a dandy roll consisting of either a screen roller alone or a screen roller disposed within a closed, circulating screen. This surface compression either applies a watermark to the fibrous web or reorients the uppermost fiber layer to achieve a greater uniformity. The disadvantage of these methods is that the zone in which the surface compression takes place cannot be freely varied; the restrictions thereon being determined, first of all by the operational speed of the machine and secondly, by the diameter of the dandy roll. An additional disadvantage of the known method is that the setting of the reoriented fibers takes place solely by the screen roller or the screen rotating together therewith separating from the fibrous web. By this means, however, the desired reorientation is partially reversed or cancelled. Furthermore, especially at high machine speeds, difficulties arise in that a portion of the water initially remains in the fabric of the dandy roll or the screen and is then thrown off in the form of droplets. These droplets then strike the newly reoriented fibrous web and again change the attained fiber positions.

OBJECT AND SUMMARY OF THE INVENTION

The basic object of the invention is to create a method for influencing the pre-drained fibrous web on a screen, particularly to reorient the uppermost fiber layer of such a web, which maintains the effect achieved by the pressure handling of the fibrous web better than the known methods. This object is achieved by a method with the characteristics of the present invention.

A reliable setting of the fibers is achieved by means of the fact that during the time period in which the fibrous web is subjected to a surface compression at least a portion of the water forced from the fibrous web is removed, at least part of which passes through the second screen. The variable duration of the surface compression thereby makes it possible to adapt to different machine speeds, resulting in the method according to the invention being usable and fully effective even at the highest machine speeds.

A final advantage is that the method according to the invention is not limited to reorienting the uppermost fiber layer to make it more uniform or to form a watermark. The removal of the water through the second screen, to which of course a simultaneous removal of water in the opposite direction can be added, i.e., through the first screen, together with the variable intensity of the water removal allow the method according to the invention to also be used to advantage when additional material such as fibers or additive substances are to be applied to or introduced into the uppermost fiber layer.

Particularly good results can be achieved when the surface compression is applied to the upper side of the fibrous web and at least a portion of the pressed out water is forcibly removed from the top side of the web.

In a preferred embodiment the water is removed separately from the air, because this produces a better result than when the water and air are drawn off together.

A further object of the invention is to create an apparatus to perform the method according to the invention. This object is achieved with an apparatus having the characteristics of this invention because the water aspirating device arranged together with the screen roller within the second screen is capable, with the aid of its screen contact surface, to continue the compression of the fibrous web coming from the screen roller and thereby draw the water pressed out of the web through the second screen to the necessary degree.

Preferably the aspirating device includes a suction box which is especially suitable for the water removal, and separate removal lines for water and air which make it possible to achieve an especially good and trouble-free setting of the fibers. If water is to be removed in the opposite direction as well, i.e., through the first screen, then it can be arranged by simply placing a conventional draining element opposite the water aspirating device.

In a preferred embodiment both the screen roller and the water aspirating device are mounted on a support device so as to be adjustable relative to the second screen. This is preferably done in such a manner that even the distance between the water aspirating device and the screen roller can be changed. The surface compression exerted on the fibrous web by the water aspirating device can then be adjusted independently of the surface compression produced by the screen roller, by which the duration of the influence on the web can also be changed. This time period is also dependent on the distance between the water aspirating device and the screen roller which can also be changed. The apparatus can therefore easily be adapted to various requirements, for which both a separate adjustment of the screen roller and the water aspirating device and a common adjustment therefor may be necessary. These adjustment possibilities are also advantageous with regard to reproducibilty of result. An especially simply designed embodiment of the support device is provided by the inclusion of a rocker arm which is provided with a pivoting device and can be set in various pivot positions. The screen roller is preferably movably mounted in this rocker arm. To adjust the screen roller, the rocker arm is moved; and if necessary, the screen roller is also moved relative to the rocker arm. The water aspirating device is thus connected with the rocker arm by means of a holding device which allows for a change in its position relative to the rocker arm and if necessary relative to the screen roller, so that the screen roller and the aspirating device can also be adjusted independently of each other.

BRIEF DESCRIPTION OF THE DRAWING

The invention is described in greater detail below with the aid of an exemplary embodiment shown in the drawing. The single drawing is a side view of the exemplary embodiment according to the present invention.

DETAILED DESCRIPTION OF THE PREFERRED EMBODIMENT

An apparatus for influencing the uppermost layer of a pre-drained fibrous web, lying on a horizontally guided longitudinal screen in a conventional manner (not shown), includes a frame indicated in general by the reference numeral 1. Frame 1 is provided in order that the apparatus for influencing the fibrous web may be disposed above the longitudinal screen and the fibrous web lying thereon. This frame 1 overlaps the top of the longitudinal screen and, as shown in the exemplary embodiment, it is connected to the table or to a foundation which supports the longitudinal screen. Two supports 2 and 3 are provided at each end—front and rear—of the frame 1, which support an upper frame 4 whose two side rails run at least approximately parallel to the lateral edges of the longitudinal screen.

A support frame 5 having a horizontal axis running laterally to the longitudinal direction of the longitudinal screen is pivotably mounted to the two supports 2 positioned downstream relative to the longitudinal screen. The ends of the two side rails extend beyond the end of the support frame 5 lying opposite the pivot axis thereof. These two parallel extensions are formed by two arms 6 which are rigidly connected with the support frame 5 and, as shown in the drawing, extend downward at an angle from the support frame 5, pressing between the two supports 3. These arms 6 also carry mounts 7 for a screen roller 8 on respective sleds 22. The axis of this screen roller 8 lies parallel to the pivot axis of the rocker arm formed by the support frame 5 and the arms 6. The sleds 22, which can be moved in the longitudinal direction of the arms 6, are moved by and held in the selected position by respective spindles which are driven by a motor 23.

One end of respective straps 9, which have axes parallel to the pivot axis of the support frame 5 are hingedly connected to the ends of the two side rails of the support frame 5 extended by the arms 6. The other end of these straps 9 is hingedly connected to a pivot frame 10 which is pivotably mounted in the upper frame 4. The pivot axis of the pivot frame 10 lies parallel to the pivot axis of the support frame 5 and is near one of the cross beams. A pneumatic working cylinder 11 engages the underside of the pivot frame 10 in the vicinity of the other cross beam near the two side rails. The angular position of the pivot frame 10 can be adjusted by this pneumatic working cylinder 11 to any desired value within the pivot range. The rocker arm, which consists of the support frame 5 and the arms 6, can therefore be pivoted with the aid of the pneumatic working cylinder 11, thus making it possible to vary the compression of the screen roller 8 against the fibrous web lying on the longitudinal screen.

A suction box 12 is arranged in the area between the two arms 6 on one side and the rear supports 2 on the other. The underside of this suction box 12, i.e., the side facing the longitudinal screen, is defined by a base plate 13 which includes numerous water discharge openings and the underside thereof forms the contact surface for a second screen 14. As shown in the drawing, the deepest portion of the slightly cylindrically curved contact surface lies approximately in the center of the base plate 13. From this point the contact surface rises toward the screen roller 8, i.e., opposite the direction of movement of the longitudinal screen, in such a manner that the plane defined by this section of the contact surface lies tangential to the screen roller 8. Accordingly, the other section of the contact surface of the base plate 13 rises somewhat toward the end opposite the screen roller 8.

The suction box 12 has separate discharge lines 15 and 16 for water and air. Furthermore, the suction box 12 is supported from the support frame 5 by means of threaded bolts 17 so as to be height-adjustable. The threaded bolts 17, as shown in the drawing, are respectively disposed on each side of the suction box 12, respectively, near the front and rear edge of its lid, so that not only a height adjustment, but also an inclination adjustment of the suction box 12 is possible with the aid of the threaded bolts 17, which are engaged in respective adjustment bushings in the support frame 5.

The second screen 14 is an endless longitudinal screen which is guided approximately vertically downward to the screen roller 8 and is then diverted into an approximately horizontal direction. The second screen 14 thus runs over the underside of the base plate 13, having the result that until it reaches the lowermost point on the underside of the base plate 13 it follows a slightly descending path and thereafter follows a slightly ascending path. A driven roller 18 supported by the rear supports 2 diverts the second screen 14 back upward to a first diverting roller 19 which is disposed above the upper frame 4 and is supported thereby. This first diverting roller 19 can be power-pivoted upward about a pivot axis 20, which is spaced from the rotational axis of said roller 19, to tighten the second screen 14. Finally, the second screen 14 passes over a second diverting roller 21, which diverts it back toward the screen roller 8.

If, for example, with the aid of this apparatus, one wishes to improve the uniformity of the uppermost fiber layer of a fibrous web lying on the longitudinal screen of the paper machine, the pneumatic working cylinder 11 adjusts the rocker arm and the screen roller 8 carried thereby to a position where the fibrous web experiences a certain compression from the screen roller 8 and the second screen 14 guided thereover. This has the result that a water film is formed on both sides of the web, which exhibits a significantly lower material density than the fibrous web has before it is subjected to the surface compression between the second screen 14 and the longitudinal screen. The reduction of material density gives the fibers of the upper surface of the web so much freedom of movement that they can be reoriented.

The suction box 12 is adjusted in such a manner that the surface compression exerted on the fibrous web is maintained between the screen roller 8 and the base plate 13 of the suction box 12 as well as in the area of this base plate 13. Therefore, the water forced from the fibrous web under the influence of the surface compression cannot reenter the web after leaving the screen roller 8. The water is partially aspirated upward through the base plate 13 by means of the suction box 12, having the result that the fibers of the uppermost layer, which have been reoriented, become fixed or set to such an extent that they can no longer change their position, even when the surface compression ceases after the web has passed beyond the area beneath the base plate 13.

By pivoting the rocker arm formed by the support frame 5 and the frame 6, the screen roller 8 and the suction box 12 can be simultaneously raised or lowered, whereby also the screen roller 8 and the suction box 12 can easily be brought into the same position relative to the longitudinal screen after being raised that they occupied prior thereto, thus making the adjustment of the apparatus significantly easier. The suction effect of the suction box 12 can be varied in order to upwardly aspirate the water from the web with the necessary intensity.

To the extent that is necessary or appropriate to aspirate the water downward as well, in the area beneath the base plate 13 the longitudinal screen is guided over at least one conventional draining element, which removes the water in a downward direction with an adjustable force.

Although only the preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A method of reorienting fibers in a top layer of a partially pre-drained fibrous web on a first screen including the steps of:

bringing a second continuous porous screen into contact with said fibrous web at a first contact point by means of a porous screen roller and at a second contact point by means of a porous base plate;

subjecting said fibrous web to a surface compression by means of the second continuous porous screen acting at and between the first contact point and the second contact point;

adjusting the distance between the first contact point and the second contact point so that the second continuous porous screen is in contact with said fibrous web over a variable time period;

moving the porous screen roller to adjust the surface compression between said porous screen roller and the second continuous porous screen independently of the surface compression between the porous base plate and the second continuous porous screen, said surface compression being adjusted to form a water film on at least one side of the fibrous web, thereby lowering the surface density of the fibrous web and allowing the fibers in the top layer of said fibrous web to become re-oriented;

maintaining this surface compression between the first contact point and the second contact point over the variable time period in order to prevent water from re-entering the fibrous web and setting the re-oriented fibers in desired positions; and removing at least a portion of the water forced from the fibrous web during the period of surface compression by causing it to pass upwardly through said second continuous porous screen.

2. The method of claim 1, wherein the surface compression is applied to the upper side of said fibrous web and said at least a portion of the water pressed out of said fibrous web is forcibly removed in an upward direction by a suction box.

3. The method of claim 1, wherein the water is removed separately from air in a suction box.

4. The method of claim 1, including the step of simultaneously adjusting the distance between positions of said porous screen roller and said porous base plate relative to the fibrous web on the first screen in order to vary the variable time period for the surface compression on the fibrous web.

5. The method of claim 1, wherein the variable time period and magnitude of the surface compression on the fibrous web is variably controlled by pivoting the porous screen roller.

6. The method of claim 1, wherein the water is removed upwardly by aspiration through a suction box arranged above the porous base plate toward the end of said variable time period.

* * * * *